United States Patent [19]

Ridgeway

[11] 4,151,798

[45] May 1, 1979

[54] SHAPED EXPLOSIVE CHARGE DEVICE FOR UNDERWATER USE

[75] Inventor: John J. Ridgeway, Aix-en-Provence, France

[73] Assignee: Imperial Chemical Industries Limited, London, England

[21] Appl. No.: 836,568

[22] Filed: Sep. 26, 1977

[30] Foreign Application Priority Data

Nov. 29, 1976 [GB] United Kingdom ..... 49622/76

[51] Int. Cl.[2] ..... F42B 3/08

[52] U.S. Cl. ..... 102/24 HC; 102/20; 175/4.52; 175/4.6

[58] Field of Search ..... 102/20, 24 HC, 56 SC; 175/4.52, 4.6; 9/11 A

[56] References Cited

U.S. PATENT DOCUMENTS

| | | | |
|---|---|---|---|
| 2,667,836 | 2/1954 | Church et al. | 175/4.6 |
| 2,690,123 | 9/1954 | Kanady | 175/4.52 |
| 3,031,964 | 5/1962 | Chesnut | 102/24 HC |
| 3,490,085 | 1/1970 | Lewis | 9/11 A |

FOREIGN PATENT DOCUMENTS

| | | | |
|---|---|---|---|
| 2254879 | 5/1973 | Fed. Rep. of Germany | 102/24 HC |
| 2523447 | 12/1975 | Fed. Rep. of Germany | 102/24 HC |

*Primary Examiner*—Verlin R. Pendegrass
*Attorney, Agent, or Firm*—Cushman, Darby & Cushman

[57] ABSTRACT

A shaped explosive charge device for underwater use wherein a deflated inflatable element is positioned within the stand-off space and, when the device is in position for firing, for example, as an inside cutter, the inflatable element is inflated to exclude water from the cavity and stand-off space between the explosive charge and the target surface.

13 Claims, 3 Drawing Figures

SHAPED EXPLOSIVE CHARGE DEVICE FOR UNDERWATER USE

This invention relates to a shaped explosive charge device for underwater blasting, metal cutting and similar operations and to a method of using a shaped explosive charge underwater.

Shaped explosive charges are designed to produce a focussed shockwave of great penetrating power directed outwardly along the axis of an outwardly divergent cavity in one face of the charge. The cavity is usually of conical, frusto-conical or sphero-conical cross-section. The cavity cross-section parallel to the base may be circular but, in elongated shaped charges used for linear and curvilinear cutters it will be rectangular or other elongate form. The explosive composition is usually disposed symmetrically with respect to the cavity axis. In use the shaped charge is placed with the base of the cavity facing towards the target surface of a work piece and, for maximum cutting effect, at an optimum distance, termed the stand-off. Usually the cavity is lined with metal to enhance the penetrating power.

The casing of the shaped charge device generally extends beyond the base of the cavity of the explosive charge to provide the required stand-off between the base of the explosive charge and the base of the casing. In devices for underwater use the cavity and stand-off space are sealed to exclude water because any dense material in this space reduces the shockwave power. Thus an underwater shaped charge device generally has a sealed charge casing devided into an explosive charge compartment and a combined cavity and stand-off compartment, the compartments being separated by a cavity liner presenting a concave surface within the stand-off compartment. Inside and outside circular cutters of this construction for cutting metal pipes have been described in United Kingdom Patent Specification No. 1,367,011.

For deep water use the shaped charge casing is required to be sufficiently strong to withstand the external hydrostatic pressure in order to prevent water leakage into the stand-off compartment. The casing is usually fabricated from heavy metal and the heavy metal at the base of the stand-off compartment diminishes the penetrative effect of the device. The penetrative effect is further diminished if there is any water present between the device and the target surface, and, with inside circular cutters, which are necessarily undersize with respect to the pipe to be cut in order to permit free movement in the pipe, there is always an annular space between the cutter and the pipe in which water will be present unless it is excluded. The usual method for exclusion of the water is to locate an inflatable tube in the annular space so that any water in the space is displaced when the tube is inflated as shown in United Kingdom Patent Specification No. 1,367,011.

It is an object of this invention to provide an improved shaped explosive charge device for underwater use, wherein the power of the shockwave is not diminished by the presence of metal or water in the shockwave path.

We have now discovered that the cavity and stand-off space of a shaped charge device for underwater use can advantageously be sealed against water ingress by a flexible inflatable element which can remain in a deflated collapsed condition until the device is positioned for use and thereafter be inflated to exclude water from the shockwave path and to provide the required stand-off distance. The metal base of the stand-off compartment can therefore be omitted. The supply of compressed gas for inflation of the element will normally be readily available at the use site.

Thus in accordance with the invention a casing for a shaped explosive charge device comprises a hollow chamber for holding an explosive charge, said chamber having a liner wall presenting a convex surface to said chamber and a concave surface externally of said chamber, said liner wall defining the cavity of the shaped explosive charge, and, adjacent to said liner wall, an inflatable flexible impervious, collapsible element, said element in the uninflated condition being essentially wholly accommodated within the casing and upon inflation expanding in said casing and in a stand-off space outwardly of said casing to confine and seal a volume of gas occupying the said cavity and the stand-off space for the explosive charge, said cavity being exposed to ambient fluid pressure which acts on or around said element.

The liner wall is preferably V-shaped in cross-section and is preferably metal, the preferred material being steel, copper or aluminium or an alloy of any of these metals.

The inflatable flexible element may conveniently be fabricated from any flexible, impervious, collapsible material, thin rubber being especially convenient. As a safeguard against rupturing, the element advantageously comprises an inner impervious member, for example, a vehicle wheel inner tube and an outer reinforcing abrasion-resistant cover, for example, of light material such as nylon cloth.

The inflatable element may form with the liner wall a complete seal over the mouth of the cavity but in a preferred construction the element itself defines a completely sealed volume and is independent of the cavity liner. In inside and outside circular cutters the flexible element is preferably a circumferential continuous tubular element.

For inflation, the inflatable element is preferably connected to a differential relief and check valve whereby the element may be pressurized accurately to a predetermined pressure in order that excessive pressure which would rupture the element may be avoided.

In a preferred construction of casing the side walls of the casing extend beyond the base of the liner wall to enclose at least a portion of the stand-off space and the inflatable, flexible element is, in its deflated condition, accommodated in the said enclosed portion of the stand-off space whereby the said element is protected from abrasion during positioning of the shaped charge device and is retained in position relative to the explosive charge when it is inflated.

The invention also includes a shaped explosive charge device comprising the aforedescribed shaped charge casing containing an explosive charge in its hollow chamber. The explosive charge is advantageously a liquid explosive and is preferably one which can be prepared at the blasting site by simple mixing of two or more components. Preferred compositions include those based on mixtures of hydrazine, hydrazine nitrate and ammonia as described in United Kingdom Patent Specification No. 1,212,582, and those based on nitroparaffin and amine, for example, nitromethane, nitroethane or nitropropane sensitised with ethylene diamine or benzylamine.

The invention is further illustrated by a shaped charge device, which is an inside circular cutter, hereinafter described, by way of Example only, with reference to the accompanying drawings wherein FIG. 1 is a diagrammatical plan view of a circular cutter in position for cutting a metal pipe (shown in transverse section) with the inflatable element inflated.

Figure 2:
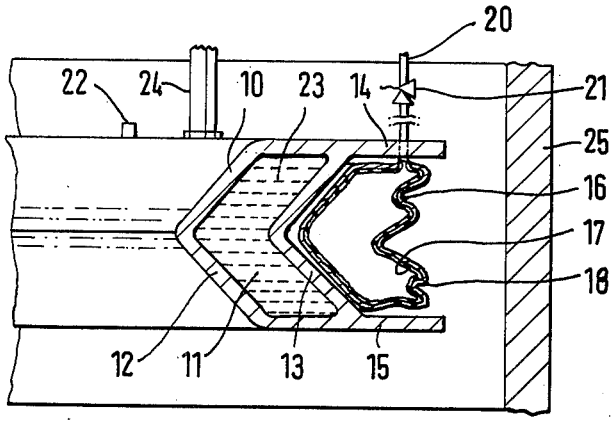
FIG. 2 is a section on the line II — II of FIG. 1 on an enlarged scale with the inflatable element collapsed for insertion of the device into the pipe.
Figure 3:
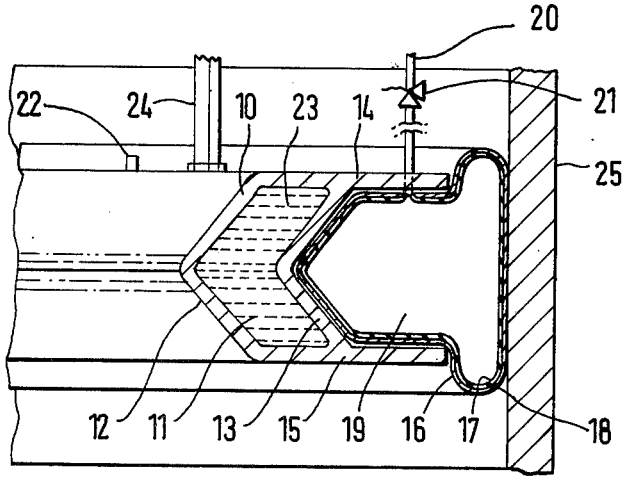
FIG. 3 is the same section of the cutter shown in FIG. 2 with the inflatable element inflated.

The device includes a hollow metal casing 10 which comprises a hollow explosives chamber 11 of chevron shaped cross-section, enclosed by two parallel circular walls 12 and 13 of V-shaped cross-section and two external flat parallel annular side walls 14 and 15. The wall 13 serves as the metal liner for the shaped explosive charge cavity. The side walls 14 and 15 extend outwards beyond the liner wall 13 and a circular inflatable element 16 is accommodated in the annular space between the extended wall portions. In FIG. 2 the element 16 is collapsed, folded and inserted wholly within the peripheral boundary defined by the walls 14 and 15 and in FIG. 3 the element is inflated, in which condition it extends outside the walls 14 and 15 to provide a gas filled cavity and stand-off space 19 for the shaped explosive charge. The element 16 is of two-ply construction and is formed from an inner tube 17 of thin rubber and a reinforcing outer cover 18 of abrasion resistant nylon cloth material. A pipe 20 inserted through the wall 14 and the outer cover 18 is connected to the inner tube 17 to permit inflation of the inner tube from a compressed gas supply. The pipe is fitted with a valve 21 at a position where it will not be damaged by the explosion of the device. The valve 21 is preferably a differential relief and check valve adapted to control the pressure in the inner tube to a value exceeding the ambient by a predetermined safe amount.

The casing 10 can conveniently be made as a welded construction from suitably formed sheer metal but is also conveniently made by casting or extruding metal. suitable metals include aluminium, iron, copper, lead or alloys of such metal, for example, brass or steel. Since the casing does not totally enclose the cavity and stand-off space, there are no stresses due to hydrostatic pressure when the device is used underwater and the casing can therefore be of light construction.

Figure 1:
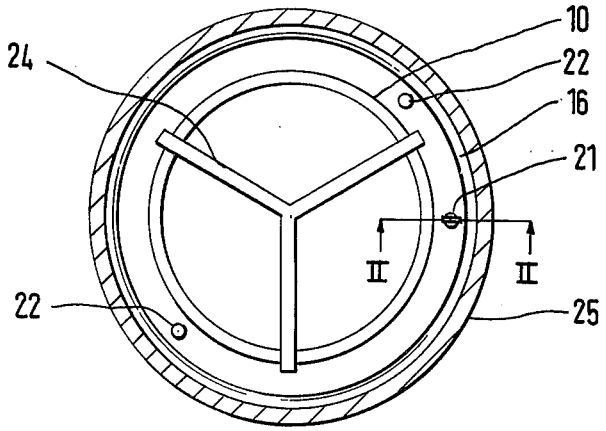

Although in FIG. 1 the casing is shown as a continuous circular casing it will be understood that it could readily, and in some cases more conveniently, be formed as two or more segments which are joined together in a composite shaped charge device.

The casing is formed with filler ports 22 through which a liquid explosive 23 is filled into the chamber 11. A spider assembly 24 is attached to the casing 10 to facilitate lowering the device into a pipe and to act as a guide and levelling device in positioning of the device.

In using the device for cutting a vertical water-filled metal pipe, for example, a pipe extending upwardly from the seabed, the device is assembled as shown in FIG. 2 with the element 16 temporarily retained within the walls 14 and 15 by adhesive tape (not shown). The device is lowered into the desired cutting position in a pipe 25, the outside limits of the walls 14 and 15 being such as to clear the narrowest portion of pipe 25 encountered by the device in its descent. Compressed gas is fed through pipe 30 into the inner tube 17 until the element 16 assumes the shape shown in FIG. 3 and all the water is forced out of the cavity and stand-off space 19. The explosive charge 23 is then detonated in known manner and the resulting focussed shockwave cuts the pipe around the circumference in the horizontal medial plane of the shaped charge device.

What I claim is:

1. A casing for a shaped explosive charge device comprising a hollow chamber for holding an explosive charge, said chamber having a liner wall presenting a convex surface to said chamber and a concave surface externally of said chamber, said liner wall defining an open base cavity of the shaped explosive charge, and, adjacent to the concave surface of said liner wall, an inflatable, flexible, impervious, collapsible element, said element in the uninflated condition being essentially wholly accommodated within the casing and upon inflation expanding in said casing and in a stand-off space outwardly of said casing to confine and seal a volume of gas occupying said cavity and the stand-off space for the explosive charge, said cavity being exposed to ambient fluid pressure which acts on or around said element.

2. A casing as claimed in claim 1 wherein the liner wall is V-shaped in cross-section.

3. A casing as claimed in claim 1 wherein the liner wall is made of steel, copper or aluminium or an alloy of any of the said metals.

4. A casing as claimed in claim 1 wherein the inflatable, flexible element comprises thin rubber.

5. A casing as claimed in claim 1 wherein the inflatable, flexible element comprises an inner impervious member and an outer reinforcing abrasion-resistant cover.

6. A casing as claimed in claim 5 wherein the outer cover comprises nylon cloth.

7. A casing as claimed in claim 1 wherein the inflatable element forms with the liner wall a complete seal over the mouth of the cavity.

8. A casing as claimed in claim 1 wherein the inflatable element defines a completely sealed volume and is independent of the cavity liner.

9. A casing as claimed in claim 1 wherein the inflatable element is a circumferential continuous tubular element.

10. A casing as claimed in claim 1 wherein the inflatable element is connected to a differential relief and check valve.

11. A casing as claimed in claim 1 wherein the side walls of the casing extend beyond the base of the liner wall to enclose at least a portion of the stand-off space and the inflatable flexible element is, in its deflated condition, accommodated in the said enclosed portion of the stand-off space.

12. A shaped explosive charge device comprising a casing as claimed in claim 1 containing an explosive charge in the hollow chamber thereof.

13. A method of cutting a metal object underwater wherein the object is cut by means of a shaped explosive charge as claimed in claim 12.

* * * * *